United States Patent [19]

Fisher

[11] 4,353,554

[45] Oct. 12, 1982

[54] ELECTRONIC RANDOM DELAY GENERATOR FOR GAME DEVICES OR THE LIKE

[75] Inventor: Laren D. Fisher, Round Lake Park, Ill.

[73] Assignee: Bally Manufacturing Corporation, Chicago, Ill.

[21] Appl. No.: 188,039

[22] Filed: Sep. 17, 1980

Related U.S. Application Data

[63] Continuation-in-part of Ser. No. 970,241, Dec. 18, 1978, abandoned.

[51] Int. Cl.[3] ..... A63F 5/04

[52] U.S. Cl. ..... 273/143 R; 273/138 A

[58] Field of Search ..... 273/138 A, 139, 143 R, 273/143 C; 364/410, 717

[56] References Cited

U.S. PATENT DOCUMENTS

| | | | |
|---|---|---|---|
| 3,684,290 | 8/1972 | Wayne | 273/143 C |
| 3,838,259 | 9/1974 | Kortenhaus | 364/717 |
| 4,087,092 | 5/1978 | Krause et al. | 273/138 A |
| 4,095,795 | 6/1978 | Saxton et al. | 273/138 A |
| 4,099,722 | 7/1978 | Rodesch et al. | 273/143 R |

*Primary Examiner*—Vance Y. Hum
*Assistant Examiner*—Leo P. Picard
*Attorney, Agent, or Firm*—Fitch, Even, Tabin, Flannery & Welsh

[57] ABSTRACT

In a game device of the type which can have one or more sets of symbols which are placed in motion in response to a player playing the game device and which also has apparatus for stopping the motion, apparatus is disclosed for generating one or more random time delays for stopping the motion of the sets of symbols.

22 Claims, 1 Drawing Figure

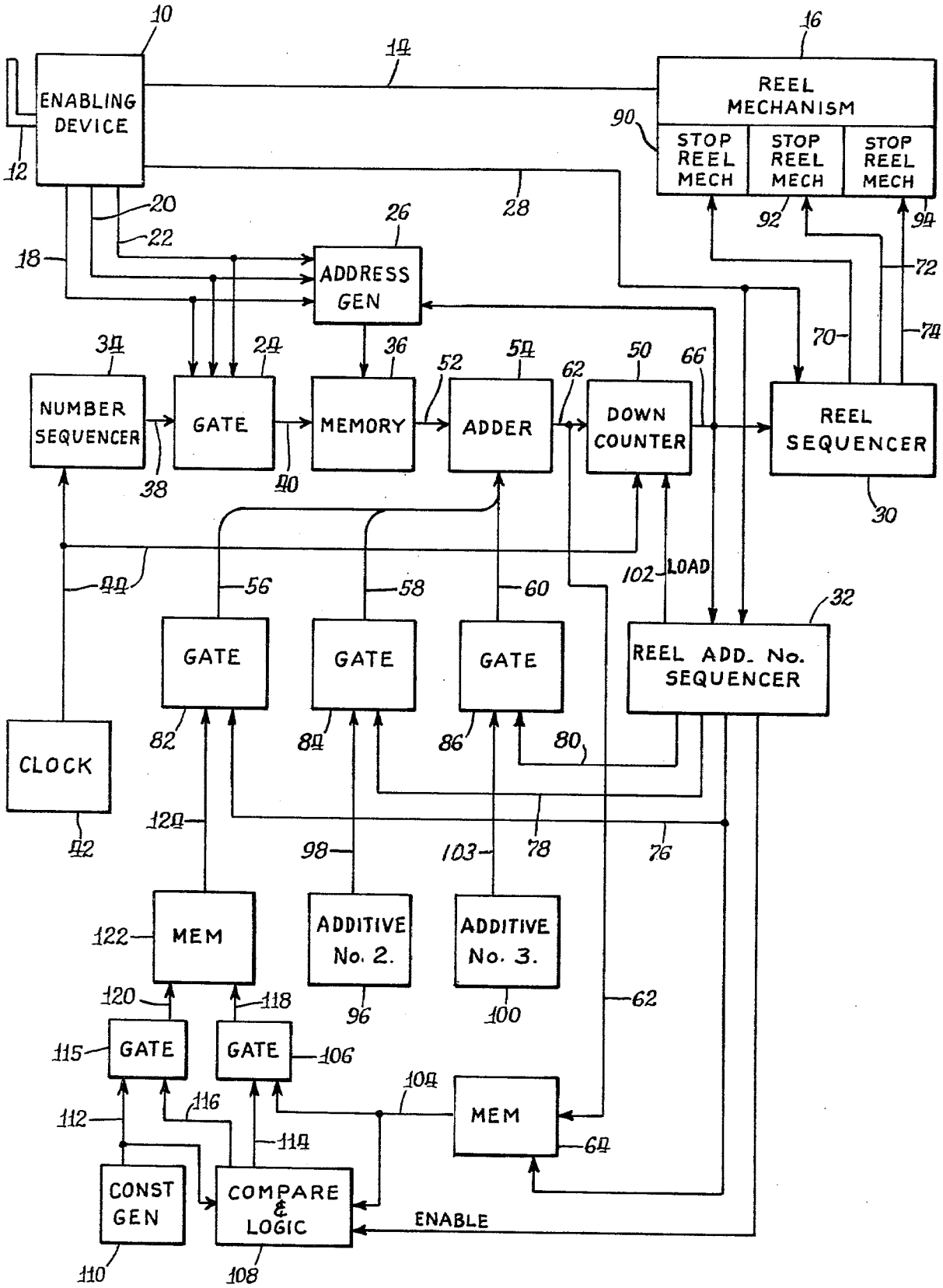
ENABLING DEVICE
REEL MECHANISM
STOP REEL MECH
STOP REEL MECH
STOP REEL MECH
ADDRESS GEN
NUMBER SEQUENCER
GATE
MEMORY
ADDER
DOWN COUNTER
REEL SEQUENCER
GATE
GATE
GATE
REEL ADD. No. SEQUENCER
CLOCK
LOAD
MEM
ADDITIVE No. 2.
ADDITIVE No. 3.
GATE
GATE
MEM
CONST GEN
COMPARE & LOGIC
ENABLE

ELECTRONIC RANDOM DELAY GENERATOR FOR GAME DEVICES OR THE LIKE

This application is a continuation in part of my previous application, Ser. No. 970,241, filed Dec. 18, 1978, now abandoned.

The present invention generally relates to game devices wherein a player inserts one or more coins and then activates the device and which generally have one or more sets of symbols which are set into motion and which are subsequently stopped, with the stop position determining a winning condition. More specifically, the present invention is directed to apparatus for generating at least one random time delay after movement has been initiated, the end of which delay determines when the movement is stopped.

The present invention is particularly applicable to game devices of the type which have symbol bearing reels, typically three or more of such reels, which are placed in motion when a player pulls a handle or pushes a button and which rotate for some period of time before they are stopped, with the particular symbols that are in view of the player determining one of several possible winning combinations. The invention is also applicable to devices which are of an electronic nature in that the symbols may have simulated movement during operation, but may in actuality be images on a cathode ray tube or other type of display device, as opposed to actual rotating reels. It should be appreciated that the apparatus of the present invention is intended to generate a random time delay that can be used with a variety of such game devices where a random time period between two operative events, such as the initiation of movement and the stopping of such movement, is desired.

The technological advances in the electronic arts have resulted in an expanding application of electronics in many industries that have heretofore been dominated by mechanical and electromechanical mechanisms, and game devices, such as those commonly referred to as slot machines, are no exception. While there have been electronic developments in the area of the foregoing game devices, the proliferation of geographical areas in the United States and elsewhere where gambling is being legalized has created a need for game devices which have random operating characteristics, but which are also reliable so that maintenance costs are minimized, and which are relatively simple and economical to manufacture.

Accordingly, it is an object of the present invention to provide an improved apparatus that can generate one or more random time delays for use in game devices of the foregoing type, which apparatus is relatively simple to manufacture, reliable in terms of randomness during operation and which requires a minimum of maintenance.

Another object of the present invention is to provide improved apparatus of the foregoing type which can be adjusted to provide several random time delays wherein each of the random time delays can vary within predetermined limits.

Other objects and advantages will become apparent upon reading the following detailed description, while referring to the attached drawing which illustrates a detailed block diagram of one embodiment of the present invention.

While referring to the drawing, it should be appreciated that the elements of the block diagram may consist of discrete integrated circuits which are commercially available as will become evident from the ensuing description. However, it should also be appreciated that the blocks shown in the drawing represent functional operations which can also be carried out by a microprocessor and associated memory together with appropriate software and it is intended that the present invention emcompass this latter alternative as well as the former which utilizes discrete integrated circuits.

More specifically, the embodiment shown in the drawing has an enabling device 10 that is preferably operated with a handle 12 in conjunction with a coin insertion detecting device. A push button switch or other device may be used rather than the handle, it being understood that some means is provided for the player to initiate operation of the device. Since the present invention is particularly adapted for use in a slot machine, it will be described in that environment and it is understood that other types of game devices may advantageously utilize the present invention. Thus, when the player pulls the handle 12 through its complete stroke, presumably after inserting the necessary coins in the game device, the enabling device 10 generates a signal on line 14 which activates a reel mechanism 16 which may be of conventional construction and which is not described herein in detail. In this regard, the device may have a drive motor that is engaged by the enabling device signal on line 14 which will energize the motor to cause the reels to be set in motion. The enabling device also has lines 18, 20 and 22 that extend to a gate 24 and to an address generator 26 and line 28 that extends to two sequencers 30 and 32 for the purpose of resetting the same to a first desired position as will be described. The gate 24 effectively gates binary numbers from a number sequencer 34 to a memory means 36 via lines 38 and 40 that is addressed by the address generator. In this regard, each of the signals on lines 18, 20 and 22 occur sequentially of one another and correspond to events that occur during the play of the device. The first occurring signal on line 18 preferably occurs as a result of the detection of the first coin that is inserted into the machine and the next signal on line 20 occurs as a result of the player starting the pull of the handle 12. The signal on line 22 occurs preferably at the end of the stroke of the handle by a player. Thus, three signals operate the gate 24 and thereby successively gate three random numbers into memory locations. It should also be appreciated that each of the three lines 18, 20 and 22 are connected to the address generator 26 and each line addresses a specific location in memory for storing the numbers that are gated from the number sequencer 34 into the memory. It is preferred that the signals on lines 18, 20 and 22 be pulses that cause the address generator to address specific memory locations in the memory 36. The signal that is applied on line 28 occurs subsequently of the signals on lines 18–22 and it is preferable that this signal be generated when the handle returns to its rest position after having being pulled through its full stroke. The number sequencer 34 is preferably a 5-bit binary counting device or ring counter which will sequentially provide a 5-bit binary output on lines 38 that is applied to the gate 24 and which will be successively incremented from 0 through 31 and be reset to zero after the terminal count when it is clocked.

A continuously operating clock generator 42 is provided and has output line 44 that extends to the number sequencer for the purpose of clocking the same and the line 44 also extends to a down-counter 50 for the purpose of decrementing its output value. Since the clock generator 42 is preferably continuously operating, the number sequencer 34 is also generally continuously incrementing through its set of numbers so that when a player inserts a coin and operates the handle 12 and causes the enabling device to generate signals on lines 14, 18, 20 and 22, the gate 24 is operated to gate each of the numbers present on lines 38 at the time onto lines 40 and into the memory 28 which stores the instantaneous numbers for the one entire play of the device. The number from the memory is also applied via lines 52 to an adder 54 which adds the random number to another additive number that is applied via one of the sets of lines 56, 58 or 60 and the summation of the two numbers is then applied via lines 62 to the down-counter 50 and to a memory 64. Each of the numbers applied via lines 62 is used to preset or preload the down-counter to a value that is necessarily between two limits, i.e., one limit being the value of the additive number and the other limit being the value of the additive number plus 31, the maximum number that could be generated by the number sequencer 34. The clock signal on line 44 from the clock generator 42 decrements the down-counter 50 which provides an output signal on line 66 which extends to the reel sequencer 30, the reel additive number sequencer 32 and the address generator 26 when it reaches a predetermined value, which is preferably zero.

The reel sequencer 30 applies the signal on one of three output lines 70, 72 and 74 and, in a similar manner, the reel constant sequencer 32 applies the signal from line 66 onto one of the lines 76, 78 and 80 which extend to respective gates 82, 84 and 86. The first time the down-counter provides a signal on line 66, the reel sequencer 30 passes the signal onto line 70 that extends to a stop reel 1 mechanism 90 which causes it to stop the first reel. The reset signal provided on line 28 is effective to set the reel sequencer 30 so that the signal on line 66 is first applied to line 70 to cause the first reel to be stopped first. Similarly, the reel sequencer 32 is reset so that the signal on line 66 is also passed to line 76 to activate gate 82. By virtue of the down-counter reaching the predetermined value and providing a signal on line 66, the reel sequencer 30 is incremented so that at the next occurrence the signal will cause an activating signal on line 72 which will cause a stop reel 2 mechanism 92 to operate and stop the second reel. Similarly, when the down-counter 50 provides a signal a third time on line 66, reel sequencer 30 will pass the signal onto line 74 which will be applied to a stop reel 3 mechanism 94 for the purpose of stopping the third reel.

Each time the down counter 50 provides a signal on line 66 which is applied to the reel sequencers 30 and 32, by virtue of line 66 extending to the address generator 26, the signal also increments the address counter so as to provide a different one of the three numbers from the memory for application to the adder 54. This enables each of the three reels to respond to a different random number from the number sequencer 34 for varying the spin time of the various reels in a more random manner than would be accomplished by a single number from the number sequencer 34, although a single number being used for each of the three reels is certainly within the scope of the present invention. When the down-counter reaches its terminal count and increments the address generator 26, the signal on line 66 also causes the reel sequencer 32 to activate one of the lines 76–80 extending to one of the gates 82–86 and additionally, each time one of the lines 76–80 is activated, line 102 which extends to the down-counter for loading the same is also activated so that the sum from the adder 54 appearing on lines 62 is loaded into the down-counter 50.

The output of the adder on line 62 also extends to the memory 64 and it is enabled to write what is present on line 62 when line 76 is activated which occurs after the handle has been pulled. Line 28 activates the reel constant sequencer 32 so as to initially activate line 76. Therefore, the number appearing at the output of the adder 54 represents the number generated by number sequencer 34 together with what was gated through gate 82 onto line 56 that is applied to the other input of adder 54. The net result is that the number which represents the sum of the two inputs to the adder 54 is written into memory 64 as is desired.

The output of memory 64 appears on lines 104 which extends to a gate 106 as well as to a comparator and logic circuit 108. A constant generator 110 is provided and has output lines 112 which extend to another gate 115 and to another input of the comparator and logic circuit 108 and provides a minimum value which, in the preferred embodiment, represents the binary equivalent of the number 100, and which, when processed through the circuitry, represents a delay or spin time of one second. This represents the minimum spin time for reel 1 during the operation of the game device. It should be appreciated that the constant generator 110 could be preset to provide a number other than 100 if desired. The comparator and logic circuit 108 compares the number supplied on lines 112 with those present on line 104 and provides activating signals on either of lines 114 or 116 to gate the signals from either of lines 104 or lines 112 through respective gates 106 or 115 onto respective lines 118 and 120 for loading the selected number into another memory 122 that has output lines 124 connected to the gate 82. If the number represented on line 104 is in excess of that present on lines 112, gate 106 will be activated to write the value of the signals on line 104 into memory 122 and this output is gated through gate 82 into the adder 54. However, if the signals on line 104 exceed a maximum value such as 200, for example, which represents a spin time of about two seconds in the illustrated embodiment, then the gate 115 will gate the minimum value generated by the constant generator 110 into memory 122 which will be gated into the adder 54 in a similar manner. As long as the value of the signals on lines 104 exceeds the value on lines 112 and does not exceed the maximum preset value, then the signals on line 104 will be gated into memory 122 and the spin time for reel 1 will be accordingly provided.

It should be appreciated that operation in the manner described will result in memory 64 having a value that gradually increases from 100 to 200 which represents a time or spin period from about one to two seconds and will gradually increase during consecutive plays of the device with the additional increment being the value that is generated for the reel 1 by the number sequence generator 34 during operation. Since the number sequencer has a range from 0 to 31, a maximum of 31 could be added to the value in memory 64 or some lesser number (including zero) could be added to the value during successive plays of the apparatus.

With respect to the reel sequencer 32, it is initially reset to provide an output on line 76 which enables the gate 82 to gate a binary number onto lines 56 that is provided by circuitry that will be hereinafter described. When the down-counter 50 reaches its predetermined count and applies the signal on line 66, the reel sequencer 32 will then activate the gate 84 and gate a binary number provided by an additive number 2 generating circuit 96 via lines 98 and similarly, when the down-counter 50 again reaches its predetermined count and applies a signal on line 66, the reel sequencer 32 will activate line 80 to enable gate 86 and gate a binary number onto lines 60 that is generated by an additive number 3 circuit 100 that is applied to the gate by lines 103. It should be realized that the additive number generating circuits 96 and 100 may comprise a 5-bit binary switch that is adjustable so as to provide any desired number for the additive number that is applied to the adder and it should also be appreciated that the values of the second and third additive numbers may be quite different from one another and can also be easily changed from time to time. Alternatively, the binary additive number values may be provided by a memory device with the control lines being used to address the appropriate memory addresses.

The frequency of the clock generating circuit 42, while preferably generally constant, may be variable if desired, and is preferably chosen to be at a rate of about 120 Hz, for example, so that each pulse that is generated by the clock corresponds to a time period of 8.33 milliseconds, or about 10 milliseconds. The rate should be compatible with the ultimate numbers that are loaded into the down-counter so that the amount of time, while random in any case, will result in the reels turning for a sufficient time that is in keeping with conventional spin times of game devices that are currently being played. Also, since the number sequencer 34 has been described as a 5-bit binary counter which will sequence through 32 possible numbers, it should be appreciated that a larger counter could be used, i.e., a 6 or even 8-bit counter if desired. In this regard it should also be realized that the clock rate should be chosen to be compatible with the total possible time that could be generated by the additive number plus the random number that is generated by the number sequencer 34.

The values of the numbers that are added to the values obtained from the number sequencer 34 should also be compatible with the clock rate and values of the number sequencer 34 to provide a desirable rhythm.

In this regard, the numbers generated by the additive number 2 and 3 generators 96 and 100 are preferably such that they will result in a shorter spin time for reels 2 and 3, and while it is not necessary, it is often desirable that the output of generators 96 and 100 be approximately the same. Thus, with the parameters mentioned for the output of memory 122, i.e., being within 100 and 200 and representing spin time periods of approximately one to two seconds, the additive number values generated by the generators 96 and 100 are preferably within the range of the binary equivalent of 40 to 60 which represents from approximately 4/10 to 6/10 of a second. It should be appreciated that since the binary equivalent of the numbers 100 and 200 produced by memory 122 require eight bits of information, the lines 124, gate 82, lines 56 as well as the adder 54, line 62 and down-counter 50 must necessarily accommodate 8-bit numbers even though the memory 36 which provides the numbers generated by the number sequencer 34 have a maximum of the number 31 which only requires five bits of binary data.

An important aspect of the present invention lies in the provision of generating random delays for permitting the reels to have the appropriate spin times in a manner whereby the rhythm of the machine is one which finds appeal by players of such machines. Although a particular play of the machine may have a relatively quick rhythm or a slow rhythm, it is primarily a function of the spin time of the first reel, and if it is slow or fast, once the first reel is stopped, the stopping of the second and third reel will occur shortly thereafter, which is effectively a function of the numbers that were generated by the number sequencer, i.e., from 0 to 31 plus the numbers generated by the additive number generators 96 and 100 which are approximately ½ second. Thus, when the player pulls the handle, the spin time of the first reel will vary from one to two seconds, but once it is stopped, the other two reels will stop approximately within about ½ second of the previous reel. It is a curious fact that game devices which do not follow this pattern or rhythm during play are viewed as being unappealing, and are quickly abandoned in favor of more desirable game devices that have the requisite rhythmical qualities.

From the foregoing description, it should be appreciated that a random time delay apparatus has been shown and described which will produce reliable operation in terms of generating a random time delay that can vary between predetermined limits. The change in rhythm that is accomplished by the amount of delay that is provided in the spinning of the first reel is a feature that players generally find to be desirable. The basic timing relationships that have been described herein, i.e., spin times of from one to two seconds for reel 1 followed by spin times of approximately ½ second for the second and third reels (as well as any additional reels if such were included) produce a desirable rhythm for the game device. The reel mechanism 16 is typically driven by an electric motor or other drive means that operates to preferably provide a full revolution of the reel in about 6/10 to 7/10 of a second. The spin time for the first reel is random because the number which is generated by the number sequencer 34 is random and is added to the number generated by the additive number generating circuitry associated with reel 1. Since the additive number for the reel 1 spin time to which the number from the sequence number generator 34 is added can be made to gradually increase. This occurs until a maximum is reached in which case the next play of the game device has a lower delay or spin time. Players generally feel that the operation of the game device is similar to that which is commonly in use, in terms of desirable rhythm and timing.

It is of course understood that although a preferred embodiment of the present invention has been illustrated and described, various modifications thereof will be apparent to those of ordinary skill in the art and, accordingly, the scope of the present invention should be defined only by the appended claims and equivalents thereof. For example, the down-counter 50, while described as a down-counter could be an up-counter that is loaded to comparable values and then up-counted to a terminal count. Similarly, while the specification and drawings have been described utilizing specific components, the functions performed by many of them could be carried out by a micro-processor and associated memory and such is certainly within the contemplation of the invention.

Various features of the invention are set forth in the following claims.

What is claimed is:

1. Apparatus for use in a game device of the type which has at least one set of symbols that sequentially appear in a viewing area when said set is placed in motion and which has at least one symbol in said viewing area when movement is terminated, comprising:

means for generating at least one enabling signal in response to a player playing said game device;

means for initiating movement of said set of symbols in response to one of said enabling signals;

means for generating a clock signal;

means for cycling through a group of numbers and generating an output signal corresponding to one of said numbers in response to receiving certain ones of said enabling signals and being driven by said clock signal;

means for storing each of said outputs from said cycling means;

means for generating a first signal indicative of a first additive value, said first additive value generating means comprising means for generating a signal corresponding to a first minimum value, means for storing the value of the first additive value from the preceding play of the game device, and means for comparing the preceding play additive value with the minimum value and means for applying the minimum value to said adding means when the preceding play additive value is below the minimum value or above a predetermined maximum value and means applying the preceding play additive value when it is not;

means for adding said first additive value signal to one of said stored output signals and providing a signal corresponding to the summed value;

counter means for receiving said summed value signal and being preset to the summed value thereof, said counter means counting to a predetermined count when driven by said clock signal and providing a counter output signal when said counter means reaches said predetermined count; and means for stopping said movement of said set of symbols in response to receiving said counter output signal.

2. Apparatus as defined in claim 1 wherein the game device is of the type which has at least two sets of symbols, said apparatus further comprising:

means for generating a second signal indicative of a second additive value;

means for applying said second additive value signal to said adding means for adding to one of said stored output signals subsequent to the stopping of the first set of symbols and providing a signal corresponding to the summed value;

means for stopping said second set of symbols in response to said counter output signal; and means for applying said counter output signal to said second set of symbols stopping means after said first set of symbols has been stopped.

3. Apparatus as defined in claim 1 wherein said first additive value generating means further includes memory means for receiving one of said minimum value and said preceding play additive value, said memory means being adapted to apply said received value to said adding means.

4. Apparatus as defined in claim 1 wherein said enabling signal generating means sequentially generates at least three enabling signals in response to the player playing said game device, said number cycling means providing a binary equivalent of a number in response to receiving each of said enabling signals, said storing means storing each of said binary equivalent signals.

5. Apparatus as defined in claim 4 wherein said enabling device of said game device has an operating handle and a coin insertion means, said enabling signal generating means generates enabling signals at the respective occurrences of a coin being inserted in said game device, said handle being initially pulled and said handle being completely pulled.

6. Apparatus as defined in claim 1 wherein said cycling means comprises a plural-bit binary counter that is incremented by said clock signal and which resets after reaching its terminal count.

7. Apparatus as defined in claim 6 wherein said cycling means further includes gating means which gate the instantaneous binary output of said binary counter to said storing means in response to one of said enabling signals.

8. Apparatus as defined in claim 1 wherein said storing means comprises a random access memory means.

9. Apparatus as defined in claim 6 wherein said storing means comprises a plural-bit binary latch means.

10. Apparatus as defined in claim 1 including at least one rotatable reel, each rotatable reel carrying a set of said symbols.

11. Apparatus as defined in claim 1 wherein said clock signal has a frequency of about 120 Hz.

12. Apparatus as defined in claim 1 wherein said counter means comprises a binary counter that is preset to the value corresponding to said summed value signal, said binary counter being decremented by said clock signal and providing said counter output signal when it is decremented to zero.

13. Apparatus as defined in claim 2 wherein said first means for applying said counter output signal comprises first sequencing means connected to the counter means and having multiple outputs, each of said outputs being connected to one of said additive value generating means, said first sequencing means being adapted to apply said counter output signal to one of said additive value generating means and activate the same when said counter output signal is generated.

14. Apparatus as defined in claim 13 wherein said enabling signal generating means is operably connected to said first sequencing means, the receipt of one of said enabling signals by said first sequencing means effectively setting the same so that the first occurrence of said counter output signal is applied to activate said first additive value generating means, the occurrence of said counter output signal also incrementing said first sequencing means so that the second occurrence of said counter output signal is applied to activate said second additive value generating means.

15. Apparatus as defined in claim 14 wherein said second additive value generating means comprises:

presettable means for providing a plurality of preselected binary outputs;

gate means having output lines connected to said counting means and input lines supplied by said presettable means and being adapted to gate the binary output values thereof to the output of the gate means in response to receiving said counter output signal.

16. Apparatus as defined in claim 15 wherein said presettable means comprises a switch having a plurality of presettable binary outputs.

17. Apparatus as defined in claim 2 wherein said second means for applying said counter output signal comprises second sequencing means connected to said counter means and having multiple outputs, each of said outputs being connected to one of said stopping means, said second sequencing means being adapted to apply said counter output signal to one of said stopping means for activating the same when said counter output signal is generated.

18. Apparatus as defined in claim 2 wherein said enabling signal generating means is operably connected to said second sequencing means, the receipt of said enabling signal by said second sequencing means effectively setting the same so that the first occurrence of said counter output signal is applied to activate said first stopping means, the occurrence of said counter output signal also incrementing said second sequencing means so that the second occurrence of said counter output signal is applied to activate said second stopping means.

19. Apparatus of the type having at least three sets of symbols that are sequenced into and out of the view of a player and/or observer when said sets of symbols are in motion and which has at least one symbol of each set in view when said motion is stopped, comprising:

means for generating at least three enabling signals in response to a player playing the apparatus, said enabling signal generating means sequentially generating at least three enabling signals, each independently occurring in response to player controlled events while the player plays said game device, said number cycling means providing a binary equivalent of a number in response to receiving each of said enabling signals, said storing means storing each of said binary equivalent signals;

means for setting each of said sets of symbols in motion in response to one of said enabling signals;

means for cycling through a predetermined group of numbers and providing a binary equivalent signal of one of said numbers at the output thereof in response to certain ones of said enabling signals;

means for generating a binary equivalent signal of a first additive value;

means for adding the binary equivalent signal of said first additive value and said one number and producing a binary equivalent signal corresponding to the sum thereof;

counter means receiving said summed binary equivalent signal and being preset thereby to the value thereof, said counter means being clocked by a clock signal and providing a counter output signal in response to said counter means being clocked to a predetermined value;

means for clocking said sequencing means and said counter means;

means operably connected to said counter means for stopping the movement of said one set of symbols in response to receiving said counter output signal;

means for generating a second binary equivalent signal of a second predetermined additive value;

means for applying said second binary equivalent value signal to said adding means subsequent to the stopping of the first set of symbols;

means for applying said counter output signal to said second set of symbols stopping means after said first set of symbols has been stopped;

means for stopping said second set of symbols in response to said counter output signal;

means for generating a third binary equivalent signal of a third predetermined additive value;

means for applying said third binary equivalent value signal to said adding means subsequent to the stopping of the second set of symbols;

means for applying said counter output signal to said third set of symbols stopping means after said second set of symbols has been stopped; and means for stopping said third set of symbols in response to said counter output signal.

20. Apparatus as defined in claim 19 wherein said first additive value generating means comprises:

means for generating a signal corresponding to a first minimum value;

means for storing the value of the first additive value from the preceding play of the game device;

means for comparing the preceding play additive value with the minimum value and for applying the minimum value to said adding means when the preceding play additive value is below the minimum value or above a predetermined maximum value and applying the preceding play additive value when it is not.

21. Apparatus as defined in claim 20 wherein said first additive value generating means further includes memory means for receiving one of said minimum value and said preceding play additive value, said memory means being adapted to apply said received value to said adding means.

22. Apparatus as defined in claim 19 including at least one rotatable reel, each rotatable reel carrying a set of said symbols.

* * * * *

UNITED STATES PATENT AND TRADEMARK OFFICE

CERTIFICATE OF CORRECTION

PATENT NO. : 4,353,554

DATED : October 12, 1982

INVENTOR(S) : Laren D. Fisher

It is certified that error appears in the above—identified patent and that said Letters Patent is hereby corrected as shown below:

Column 7, line 34, after "means" insert --for--.

Signed and Sealed this

*Fifteenth* Day of *February 1983*

[SEAL]

*Attest:*

GERALD J. MOSSINGHOFF

*Attesting Officer*

*Commissioner of Patents and Trademarks*